United States Patent [19]

Murakami

[11] Patent Number: 4,541,129

[45] Date of Patent: Sep. 17, 1985

[54] SWEAT ABSORBENT UNDERSHIRT

[76] Inventor: Hideo Murakami, 7-23, 2-chome, Komatsu, Higashi-yodogawa Ward, Osaka, Japan

[21] Appl. No.: 557,896

[22] Filed: Dec. 5, 1983

[51] Int. Cl.[4] ..... A41B 9/06

[52] U.S. Cl. ..... 2/113

[58] Field of Search ..... 2/113, 111, 2.1, 81

[56] References Cited

U.S. PATENT DOCUMENTS 2,308,337 1/1943 McDonald ..... 2/113

4,170,793 10/1979 O'Brien ..... 2/113

*Primary Examiner*—Doris L. Troutman

*Attorney, Agent, or Firm*—Moonray Kojima; Moonray Kojima

[57] ABSTRACT

This invention is concerned with a sweat absorbent undershirt adapted to be used as an undershirt for sportwares which sport players generally put on when they play golf, tennis and etc.; by wearing this sweat absorbent undershirt next to their skin, the skin is prevented from being all covered in sweat however profuse perspiration they get in while playing. The invention further involves a sweat absorbent undershirt construction provided with a high degree of sweat absorptive clothings wherein sweat remains held thereby to permit players to play free from feeling uncomfortable with sweat which otherwise they might do.

3 Claims, 5 Drawing Figures

SWEAT ABSORBENT UNDERSHIRT

BACKGROUND OF THE INVENTION

When persons are long exposed outdoors on hot summer days or when they play vigorously outdoor sports, they easily get wet with profuse sweat on their skin; the sweat being absorbed into their sportware fibers, for example, which they wear next to their skin so that the ventilative portions of the shirt clothing are closed to decrease in ventilating faculty, and especially when they get in perspiration profusely, they must keep on playing uncomfortable with the sweat all covering their skin.

In order to get rid of the above-mentioned discomfort caused by sweat, there are on sale varieties of undershirts composed of mesh-netting clothings which are superior in ventilative property. The disadvantage with this case is, however, that the mesh-netting clothing itself is almost short of sweat absorbent quality, and a great quantity of sweat breaking out on the body drops down along the body thereby being held along the upper portion of trousers which players put on, resulting in their waist portions being wet very uncomfortably.

OBJECTS OF THE INVENTION

Accordingly, the present invention has been devised to eliminate or mitigate the above-mentioned drawbacks and disadvantages of the conventional sweat absorbent undershirt at market, having for one of its main objects a provision of a sweat absorbent undershirt composed as the whole of mesh-netting clothing having a high degree of ventilative property which serves to diminish a quantity of sweat that breaks out on the body whereby all the sweat is effectively absorbed into the clothings disposed at suitably spaced apart intervals.

Another object of the invention is to provide a sweat absorbent undershirt wherein a clothing is provided internally of the mesh-netting clothings that the former clothing is partially in touch with the skin or body whereby diminishing the contacting resistance of the clothing against the skin or body, consequently enabling players to move more comfortably than the conventional one that always goes with sweat covering all the skin or body.

Another object of the invention is to provide a sweat absorbent undershirt that comprises a sweat absorbent and sweat holding clothing formed into a plurality of strip shapes in circumferential relation with said clothing and connected to a vertical clothing thereby to allow each of said strip shape clothings to absorb a quantity of dropped sweat in sequence, thus resulting in the lowermost waist portions being free of moisture.

A further object of the invention is to provide a sweat absorbent undershirt that has a cloth provided on its outer surface area with pilenapped thick towel clothing that makes players feel comfortable; said towel clothing being designed with a beautiful sense of different clothing as desired thereby increasing in value of superior designed undershirt.

A still object of the invention is to provide a sweat absorbent undershirt, which is suitable not only to underwear but also to sport shirts and T shirts as long as these are put on players to their skin.

DETAILED DESCRIPTION OF THE INVENTION

Figure 1:
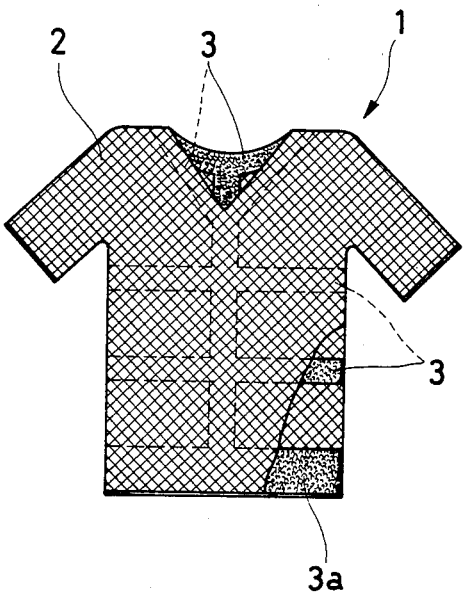
FIG. 1 is a front elevational view showing an underwear that is provided with a mechanism for preventing sweat from covering players' skin illustraling partially broken.
Figure 2:
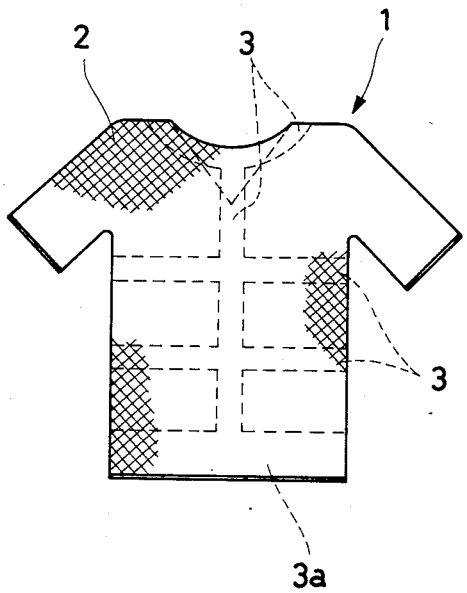
FIG. 2 is a back elevational view thereof.
Figure 3:
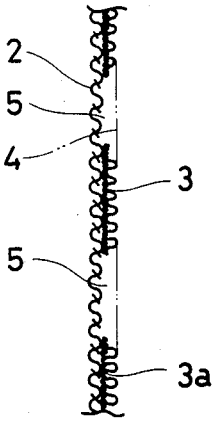
FIG. 3 is a partially enlarged vertical cross-sectional view thereof.

Now setting forth in detail a few preferred embodiment of the invention in conjunction with the accompanying drawings wherein numeral 1 in FIGS. 1 thru 3 generally designates an undershirt with half-length sleeves provided with a mechanism for preventing sweat from covering the skin or body. Said undershirt 1 is obtained by sewing a mesh-netting cloth 2 which is made of cotton used for general type undershirts with a clothing 3 which is superior in sweat absorbent quality. For a fuller understanding, a mesh-netting undershirt with half-length sleeves is in the first instance sewed with said mesh-netting cloth 2, thereafter said cloth 3 (which will be described hereinafter) being sewn internally in vertical relation with said mesh-netting cloth 2. Said cloth 3 is preferably made of a fiber comfortable to the skin such for example as Tevilon (trade mark) fiber formed in pile shape.

Said cloth 3 is sewn to the inner surface area of said mesh-netting cloth 2 in such a manner that a plurality of strip shape clothings each of which is cut into width of a few centimeters has its inner surface area of piles comfortable to the skin inseparably sewn around a V shape neck, upper and lower portions of breast, around an abdominal portion and vertical lines of both an intermediate front portion and an intermediate rear portion, respectively.

Incidentally, in order to secure absorption of a great quantity of sweat, strip shape clothing 3*a* corresponding to the lowermost abdominal circumference is preferably made widened so as to prevent sweat from dropping.

Further inasmuch as the width itself of said cloth 3 is adapted to carry out said mechanism for preventing sweat from covering the skin or body 4 with respect to said mesh-netting cloth 3 corresponding to the dimension of a space 5 defined between said mesh-netting cloth 2 and the skin or body 4, said cloth 3 is preferably wider than the general types.

When use is made of the undershirt 1 of the invention which is sewn as in the foregoing description, said cloth 3 sewn internally of said undershirt 1 absorbs the whole quantity of sweat, and moreover both the mesh-netting clothing 2 and the cloth 3 are scarcely in touch with one another due to the existence of the space 5 so that players can always play without feeling uncomfortable with sweat.

Incidentally, being small as the whole in touching surface area to the skin or body 4, said clothing 3 is easily adaptive in accordance with the movement of players. Thus even in case a more quantity of sweat may be absorbed, it is additionally absorbed by each of said strip shaped clothings; a quantity of sweat held in the clothing 3 is guided, as occasions need, to the clothing around an abdominal portion to be absorbed therein along the vertical lines of said intermediate front portions and said intermediate rear portions thereby to completely prevent sweat from sticking to the mesh-netting clothing 2 howsoever profuse perspiration players may get in.

On the other hand, in case players do not get in perspiration, they can put on the undershirt 1 of the invention comfortably due to the constant touch of the soft pile clothing 3.

In the preceeding embodiment of the invention, the clothing 3 is preferably mounted to portions wherein perspiration is profuse subject to the width of clothing 3 and each shape of the undershirt 1. In this connection, said mesh-netting clothing may have its coarse surface area as desired, and any other kind of fibers, such for example as nylon or similar synthetic resin monofilament, to which sweat is liable to easily stick, may be employed.

ANOTHER EMBODIMENT

Figure 4:
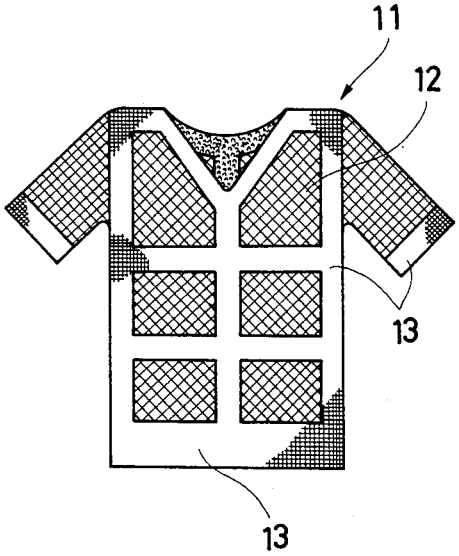
FIG. 4 is a front elevational view illustrating another embodiment of the invention.
Figure 5:
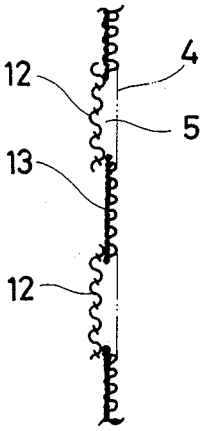
FIG. 5 is a partially enlarged vertical cross-sectional view thereof.

In FIGS. 4 and 5 of the drawings are shown and illustrated another embodiment of the invention, according to which a T shirt 11 is sewn in the manner that a mesh-netting clothing 12 is not overlapped with a clothing 13, being provided with an efficient ventilative property.

To said undershirt 11 is additionally sewn clothings that form both circumferential portion of each sleeve and vertical lines at both sides of the sleeves so as to completely prevent the mesh-netting clothing 12 from dropping thereabout.

It should be noted that the present invention, illustrated and described in detail in the drawings and foregoing description, is to be considered as illustrative and restrictive in character, and that all changes and modifications that come within the spirit of the present invention are included.

What is claimed is:

1. A sweat absorbent undershirt comprising a pair of open arm portions, an open neck portion, and a body portion having a top part and a bottom part, said top part of said body portion being connected to said pair of arm portions and said neck portion, wherein further comprising a pile napped sweat absorbent cloth disposed on the inside of said undershirt and exposed to the body of a wearer, said pile napped cloth comprising a first panel disposed completely around the bottom part of said body portion, a second panel disposed completely around said open neck portion, and a plurality of third panels disposed between said top part and said bottom part with space between each of said third panels, and each third panel disposed only partially around said body portion, and at least one vertical panel connecting the first panel, second panel and plurality of third panels; and a mesh netting cotton cloth connected to at least each of said panels of said pile napped cloth;

whereby said panels absorb seat of the wearer and said first panel prevents sweat from dropping below the bottom part of said undershirt.

2. The undershirt of claim 1, wherein said mesh netting cloth extends over the entire undershirt and is disposed as an outer layer to said pile napped cloth layer.

3. The undershirt of claim 1, wherein said mesh netting is formed only between each of said panels of said pile napped cloth.

* * * * *